US005487242A

United States Patent [19]

Stafford

[11] Patent Number: 5,487,242

[45] Date of Patent: Jan. 30, 1996

[54] METHOD AND APPARATUS FOR UNIFORMLY TENSIONING FABRIC PANELS OF PORTABLE BUILDINGS

[76] Inventor: Robert M. Stafford, 4838 Solus Pl., Weed, Calif. 96094

[21] Appl. No.: 233,122

[22] Filed: Apr. 26, 1994

[51] Int. Cl.[6] ..... E04B 1/32

[52] U.S. Cl. ..... 52/86; 52/222; 52/273

[58] Field of Search ..... 52/222, 273, 86

[56] References Cited

U.S. PATENT DOCUMENTS

| | | | |
|---|---|---|---|
| Re. 28,012 | 1/1972 | Huddle . | |
| Re. 30,044 | 7/1979 | Huddle . | |
| 3,215,153 | 11/1965 | Huddle . | |
| 3,273,574 | 9/1966 | Huddle . | |
| 3,376,879 | 4/1968 | Huddle . | |
| 3,388,711 | 6/1968 | Huddle . | |
| 3,465,764 | 9/1969 | Huddle . | |
| 3,636,676 | 1/1972 | Moss . | |
| 3,640,296 | 2/1972 | Huddle . | |
| 3,675,380 | 7/1972 | Moss . | |
| 3,699,987 | 10/1972 | Huddle . | |
| 3,708,944 | 1/1973 | Miyake | 52/86 |
| 3,726,294 | 4/1973 | Huddle . | |
| 3,744,205 | 7/1973 | Moss . | |
| 3,802,450 | 4/1974 | Huddle . | |
| 3,811,454 | 5/1974 | Huddle . | |
| 3,818,669 | 6/1974 | Moss . | |
| 3,837,405 | 9/1974 | Huddle . | |
| 3,838,726 | 10/1974 | Vredevoogd . | |
| 3,856,029 | 12/1974 | Huddle . | |
| 3,899,854 | 8/1975 | Huddle . | |
| 3,909,993 | 10/1975 | Huddle . | |
| 3,953,955 | 5/1976 | Huddle . | |
| 3,958,588 | 5/1976 | Huddle . | |
| 3,961,638 | 6/1976 | Huddle . | |
| 3,990,194 | 11/1976 | Huddle . | |
| 4,028,861 | 6/1977 | Huddle . | |
| 4,034,772 | 7/1977 | Huddle . | |
| 4,036,244 | 7/1977 | Huddle . | |
| 4,092,992 | 6/1978 | Huddle . | |
| 4,148,332 | 4/1979 | Huddle . | |
| 4,275,537 | 6/1981 | Pinson . | |
| 4,527,362 | 7/1985 | Tobey et al. | 52/71 |
| 4,593,710 | 1/1986 | Stafford et al. | 52/86 |
| 4,644,706 | 2/1987 | Stafford et al. | 52/86 |
| 5,146,722 | 9/1992 | Stafford | 52/222 |

OTHER PUBLICATIONS

*House and Home–New Experimental,* vol. XVII, Jan. 1960, p. 156.

*Primary Examiner*—Carl D. Friedman
*Assistant Examiner*—W. Glenn Edwards
*Attorney, Agent, or Firm*—Merchant, Gould, Smith, Edell, Welter & Schmidt

[57] ABSTRACT

A building structure has a plurality of arches having supporting base plates with J-brackets at lower ends of the arches, a plurality of horizontally extending purlins rigidly connected between adjacent arches for cross-bracing adjacent arches, a plurality of panels connected between corresponding arches. The panels have reinforced lower corners and a first line secured to opposite reinforced corners and extending generally arcuately therebetween and a second line secured by the J-bracket to opposite reinforced corners and extending generally linearly therebetween.

16 Claims, 5 Drawing Sheets

METHOD AND APPARATUS FOR UNIFORMLY TENSIONING FABRIC PANELS OF PORTABLE BUILDINGS

BACKGROUND OF THE INVENTION

1. Field of the Invention

The present invention relates to portable building structures, and more particularly, to uniformly tensioning panels of portable building structures.

2. Description of Related Art

The need for portable, inexpensive, and quickly erectable temporary building structures has led to the development of flexible, fabric covered, frame structures. These portable structures typically are insulated, and thus provide heating and cooling capability comparable to permanent building structures of wood, masonry, concrete or steel.

Portable building structures have been developed which include a plurality of transverse metal arches with individual flexible panels stretched between the metal arches. The panels are stretched by separating the arches and/or pulling transversely on the ends of the panels to form an enclosed area.

However, strength as well as aesthetic appearance is extremely important, for obvious reasons, when portable buildings are used for commercial purposes. Uniform tensioning of the panels causes the stress throughout the panels to be evenly distributed, thereby strengthening the entire structure. Further, uniform tensioning of the panels reduces or eliminates visible wrinkles in the stretched panels. Therefore, uniformly tensioned panels result in strong and appealing building structures and are highly desirable.

U.S. Pat. No. 5,146,722, issued on Sep. 15, 1992 to the present applicant, and incorporated by reference herein, discloses a fabric structure with double tensioning cables for accomplishing transverse stretching of fabric panels. The structure includes a plurality of cables forming large catenary arches, each having a lower end. Also, each lower end is attached to a respective base plate. The fabric panels are stretched between the large catenary arches while being held securely at the respective lower end by the respective base plate. However, although wrinkles are limited, it would be desirable to eliminate all wrinkles and to also have smaller catenary arches. Therefore, there is a need in the art for a method and apparatus for uniformly stretching and tightening all portions of the panels to eliminate wrinkles and to decrease the size of the catenary arches.

SUMMARY OF THE INVENTION

To overcome the limitations in the prior art described above, and to overcome other limitations that will become apparent upon reading and understanding the present specification, the present invention discloses a rapidly erectable building structure having a plurality of arches having supporting base plates with J-brackets at lower ends of the arches, a plurality of horizontally extending purlins rigidly connected between adjacent arches for cross-bracing adjacent arches, a plurality of panels, and means for connecting the panels to corresponding arches. The panels have reinforced lower corners. A first line is secured to opposite reinforced corners of each panel and extends generally arcuately therebetween, and a second line is secured by the J-bracket to opposite reinforced corners of the panel and extends generally linearly therebetween.

It is therefore the primary object of the present invention to provide an improved covered frame structure that is uniformly tensioned to create a strong and an aesthetically appealing wrinkle-free structure.

Another object of the present invention is to provide a structure that is portable and quickly assembled.

Another object of the invention is to keep the number of different component parts to a minimum and to allow the use of tools and equipment that are standard hardware store items.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Figure 1A:
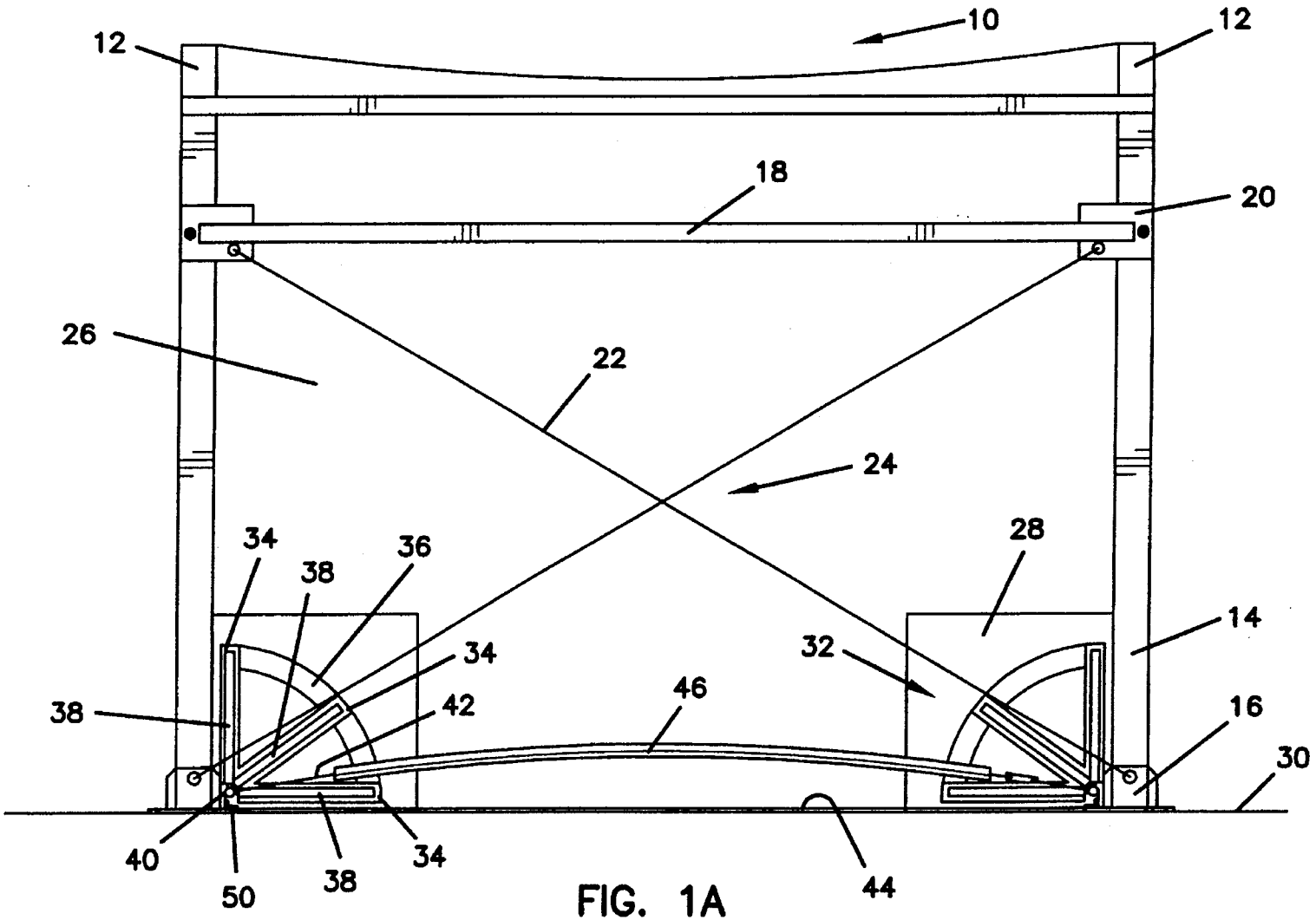
FIGS. 1A and 1B are a side elevation view and a front elevation view, respectively, illustrating a portion of a building constructed in accordance with the present invention.
Figure 1B:
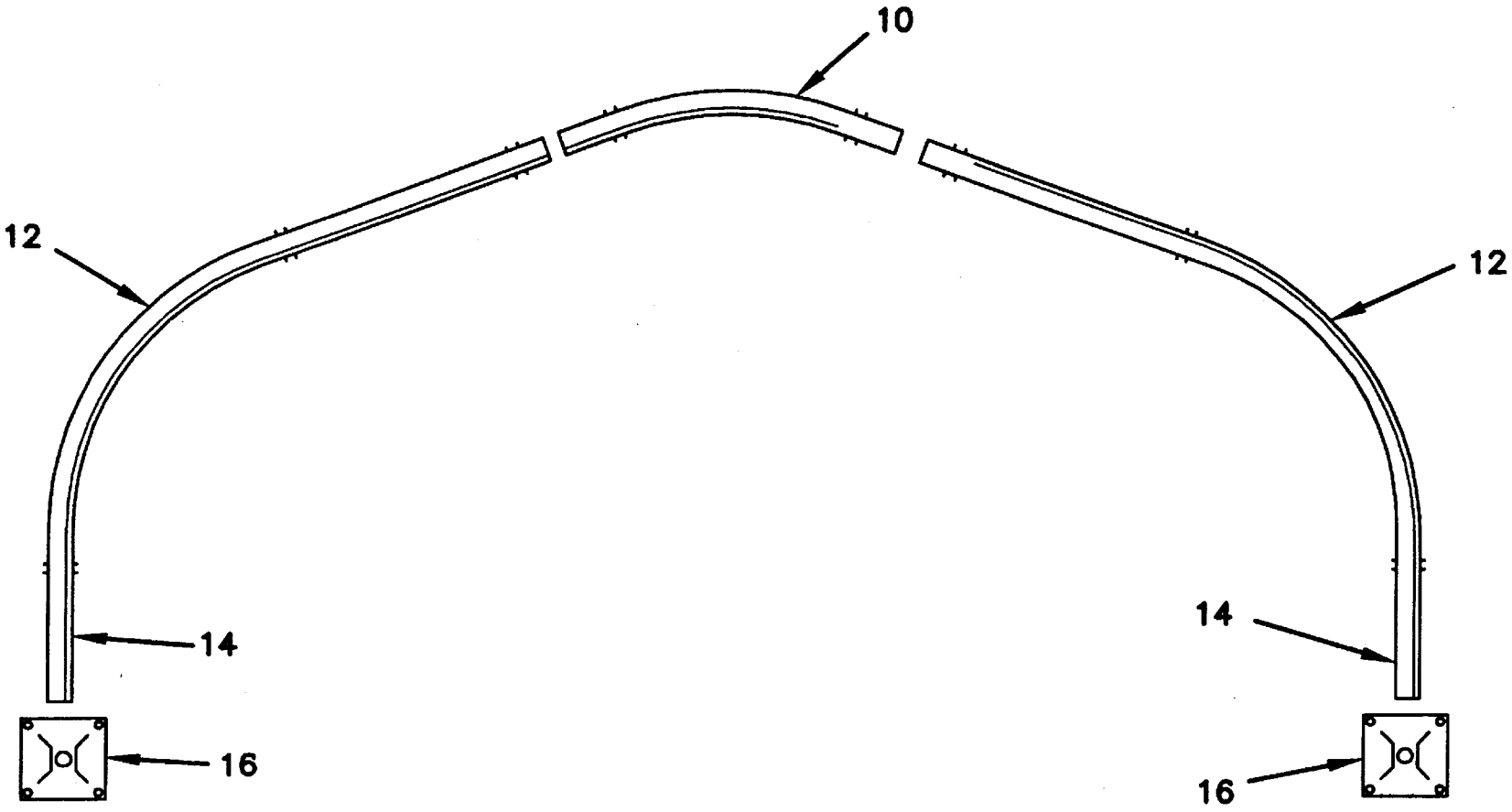

FIGS. 1A and 1B show a side elevation view and a front elevation view, respectively, illustrating a portion of a building constructed in accordance with the preferred embodiment of the present invention. Building structure 10 includes arches 12 having lower ends 14. Each arch 12 includes a plurality of hollow extruded aluminum box beam segments joined end to end via internally inserted aluminum or other metal moment splices (not illustrated). The shapes of the box beam segments, i.e., straight, slightly curved, etc., are selected to achieve both the span, pitch and profile of the desired building design and can be altered according to the particular usage, snow load, and other design parameters.

Base plates 16 hold the lower ends 14 of the arches 12 and position the arches 12 in longitudinally spaced, transversely extending, vertical positions. Each arch 12 is secured to a base plate 16 using bolts inserted through holes in the base plate 16. Each base plate 16 is secured to the ground using stakes or anchors inserted through holes in the base plate 16.

The arches 12 are rigidly connected to horizontally extending purlins 18, wherein opposite ends 20 of each purlin 18 are bolted to the arches 12. The structure 10 is cross-braced by cables 22 between adjacent vertical arches 12. The cables 22 are attached at the base plates 16 and at the ends 20 of the purlins 18, thus creating a cross-brace 24 between the purlins 18 and the base plates 16. The cables 22 are connected to each base plate 16 and each purlin end 20 by a standard eye bolt (not shown). With the cross-bracing 22, the arches 12 become taut and are not allowed to sway. Thus, the structure 10 is stronger, can carry heavier loads, and wrinkles are reduced.

The building structure 10 further includes panels 26, preferably made of a flexible web textile material, connected between adjacent arches 12. The panels 26 can be high strength durable web material, coated or laminated, polyester vinyl chloride (PVC) fabric. The web material may also comprise various other coated and uncoated woven fabrics. The panels 26 are stippled and extend all the way to the ground 30, so that the interior of the building structure 10 is completely enclosed.

The panels 26 are anchored at the lower corners 28 thereof to the base plates 16. Each lower corner 28 has a reinforced section 32 including at least three layers of reinforcement. The first layer is the textile/fabric material that encompasses the entire structure. The second layer comprises a plurality of PVC material prongs 34 extending from the lower corner of the panel 26 at varying angles, to form an arcuate face 36. The PVC prongs 34 are welded to the panel 26. The adjoining surfaces of the PVC prongs 34 and the panel 26 are brought into molten state and after the source of welding heat has been removed, the liquid solidifies, thus joining or welding the parts together. Those skilled in the art will recognize that the PVC and the panels 26 can be joined by dielectrically welding, hot-gas welding, friction welding, heated tool welding, ultrasonic welding or any other method suitable for the purpose. Since the PVC used has a high degree of polymerization, a strong joint sufficient for the stated purpose is obtained.

The third layer is a pronged web 38 of tightly woven cloth or high strength fabrics, wherein each cloth prong is aligned with the PVC prongs 34 and is stitched into the first layer, second layer, and the panel 26. Also, the proximal ends of each cloth prong located near the base plate 16 are joined by a metallic O-ring 40 to form a single location or point.

The reinforced corner 32 allows the tensile forces exerted on the lower corner 28 toward the ground 30 to be evenly distributed away from the lower corner 28 toward the body or center of the panel 26. For example, if the panel 26 is tensioned at a single point at the lower corner of the panel (metallic O-ring 40) without reinforced prongs, the tensile forces exerted on the lower corner 28 toward the ground 30 would be distributed linearly (a single force) from the lower corner 28 at a 45 degree angle relative to the ground 30. Essentially, the single tensile forces on the single point in the corner would create eccentric loading (longitudinal forces and transverse forces varying in magnitude along a body) throughout the body of the panel 26 with the largest tensile forces along a 45 degree angle.

However, as in the present invention, the lower corner 28 is reinforced with an arcuate face 36 and prongs 34 and 38 of varying angles from the ground 30. Distal ends of the prongs 34 and 38 form the arcuate face 36 that converts the single linear force from the single point in the lower corner 28 (the O-ring 40) to many arcuate forces. Thus, the large single linear tensile force is broken down into numerous smaller tensile forces that are evenly distributed to form the corner 28 of the panel 26.

Further, each panel 26 has lines 42 and 44 connecting opposite reinforced lower corners 28 of each panel 26. Line 42 extends arcuately between opposite lower reinforced corners 28 of the panel 26. Thus, line 42 forms a catenary arch with a substantial radius of curvature (i.e., small catenary arch) on each lower portion of each panel 26. However, line 44 extends linearly between opposite lower reinforced corners 28 of the panel 26. The panel 26 may have a channel or sleeve 46 with a flange opening so that line 44 is not visible and is fed through the channel 46. Channel 46 may be welded to the panel 26, as described above, along the entire segment thereof that overlies the width of the panel 26. Each line 42 and 46 may comprise a three-sixteenths inch stranded stainless steel cable. In addition, lines 42 and 46 of each panel 26 have terminal segments that end at the O-ring 40. Thus, the terminal segments of lines 42 and 46 are coupled to each other via the O-ring 40.

Figure 2:
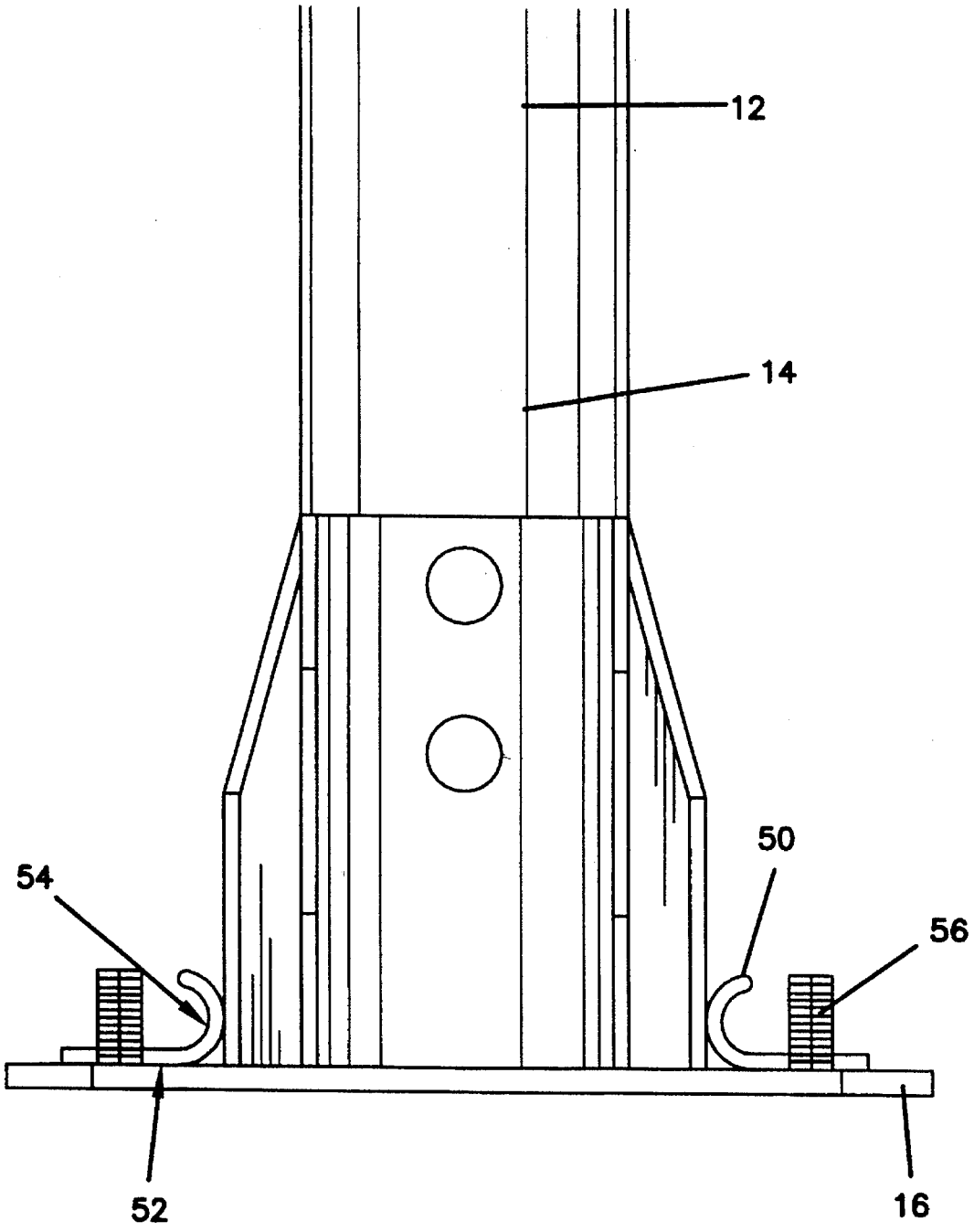
FIG. 2 is a op view of the J-bracket and the base plate.
Figure 3:
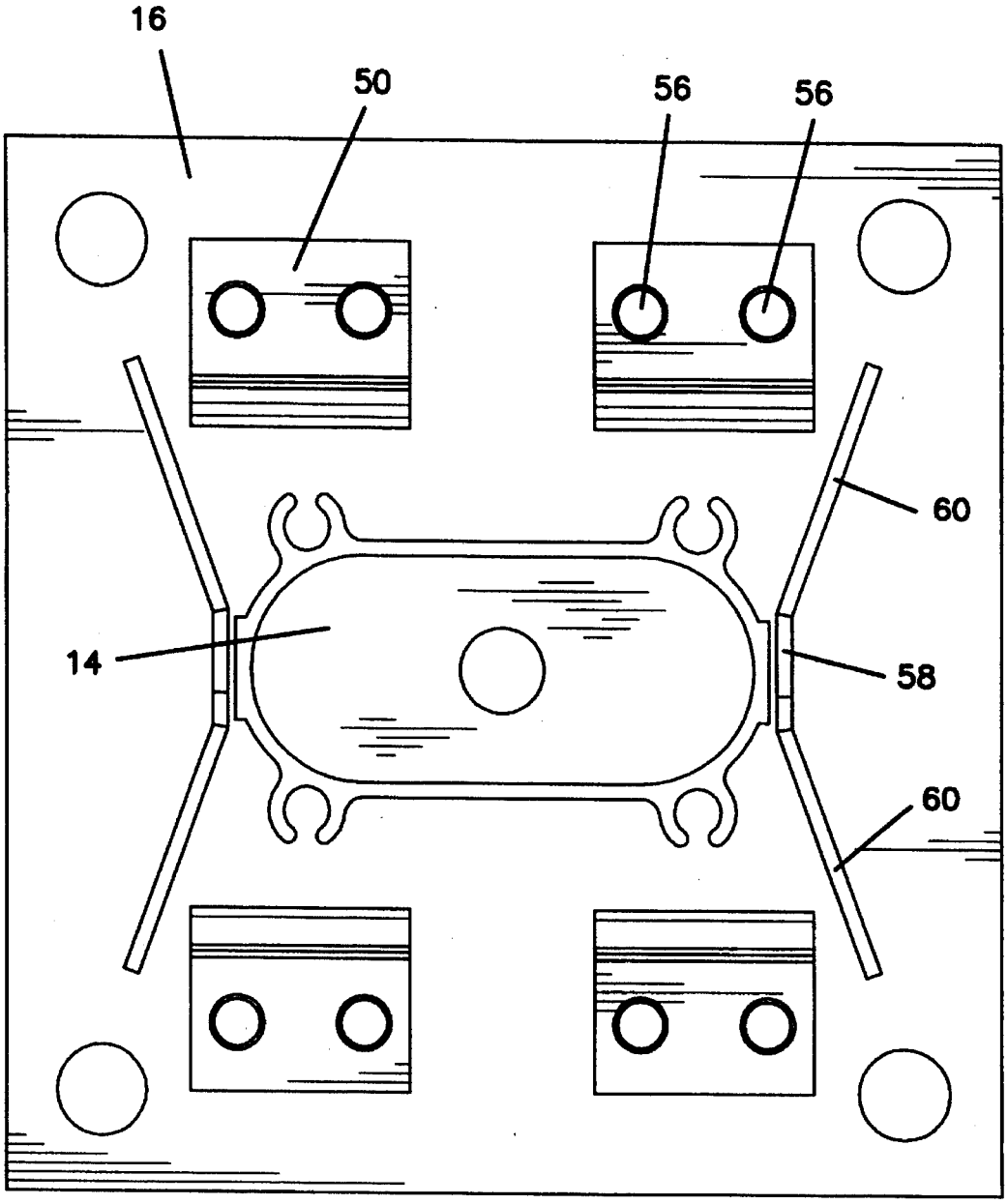
FIG. 3 is a side view of the J-bracket and the base plate.

FIG. 2 illustrates a top view of the J-brackets 50 and the base plate 16 and FIG. 3 illustrates a side view of the J-brackets 50 and the base plate 16. Each base plate 16 includes at least one J-bracket 50. However, the preferred embodiment includes four J-brackets 50, two on each side of the base plate 16 adjacent to the panel 26. Each J-bracket 50 has a flat center 52 and a curled end 54. The curled end 54 of each J-bracket 50 is at proximal ends located near each respective arch 12. A bolt and nut system 56 is located at the flat center 52 of the J-bracket 50 and secures the J-bracket 50 to the base plate 16.

Each base plate 16 includes means for rigidly connecting a corresponding lower end 14 of one of the arches 12 to the base plate 16. This connecting means may take the form of a pair of vertical metal brackets 58 welded to the base plate 16 which are positioned for receiving the lower end 14 of arch 12 therebetween. The brackets 58 have holes for receiving bolts (not illustrated) that may be tightened into threaded holes in the lower end 14 of the arch 12. Pairs of ears 60 are formed by the metal bracket 58 or can be welded to each bracket 58 and extend outwardly therefrom.

Figure 4:
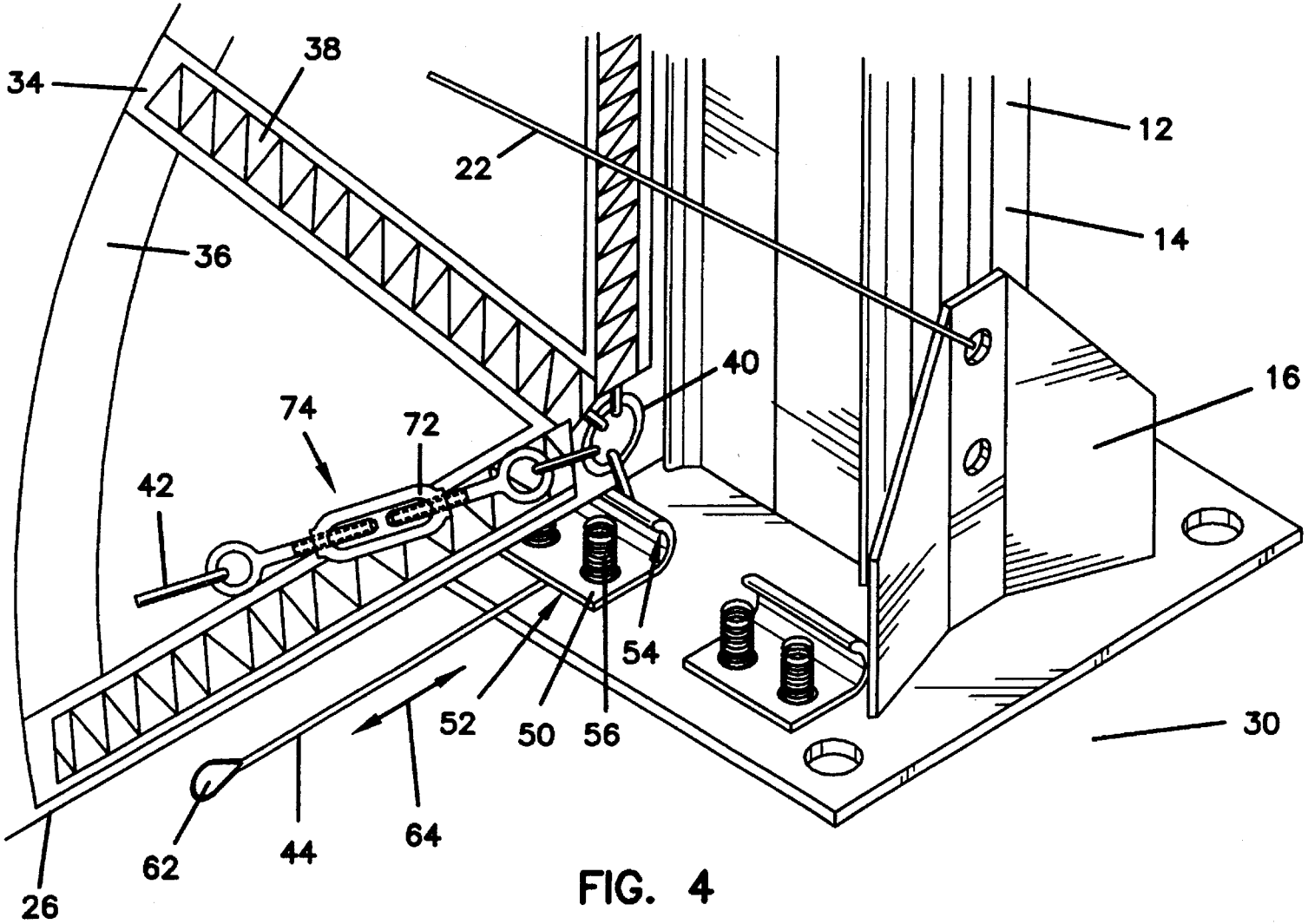
FIG. 4 enlarged fragmentary perspective view illustrating the interaction between the cables, the end portions of the fabric panels, the base plate, and the J-bracket of the preferred embodiment of the present invention.

FIG. 4 illustrates an enlarged fragmentary perspective view of the interaction between the cables 22, the end portions 28 of the panels 26, the base plate 16, and the J-bracket 50. The J-bracket 50 is installed on the base plate 16 over line 44, where line 44 is underneath the flat center 52 and between the bolt and nut system 56 of FIG. 3, so that the bolt/nut system 56 straddles line 44. Line 44 is securely held by the J-bracket 50 and is safe from cuts or damage from the J-bracket 50 since the flat portion of the J-bracket 50 is clamping line 44.

Line 44 can have a shackle, turnbuckle, winch or come-along 62 to form line 44 for ease of tensioning. Slack on line 44 is taken up first to bring the panels 26 down toward ground level 30 and make the panels 26 tight in the arches 12. This pulling is illustrated by the arrows 64 in FIG. 4 and is accomplished by turning the turnbuckle or cranking the winch or come-along 62, so that line 44 pulls the O-ring 40 down against the curved end 54 of the J-bracket 50. For example, line 44 may be two cables 66 and 68 having permanent loops 70 on each end to facilitate rapid connection to a quick release winch or come-along 62 between the two cables 66 and 68. Once the winch 62 is connected between the two cables 66 and 68, the winch 62 may be jacked to pull the ends of each respective cable 66 and 68 together.

Line 42 is tensioned to hold the lower end of each panel 26 into position. Also, the tensioning of line 42 tightens the surface area of the panel 26 above line 42, thereby keeping the panel 26 free from wrinkles. This is accomplished by turning a sleeve 72 on a turnbuckle 74 of line 42 to tighten the line so that the connected parts (opposite lower ends 28 of the panels 26) are drawn together, thereby taking up slack and producing necessary tension in line 44. Thus, the tensioning of line 44 places the final tension on the panels 26 necessary to prevent wrinkles and allow uniformly distributed tensile forces throughout the panels 26. This two-step tensioning procedure allows the panels 26 to be consistently positioned and pulled to a specific point every time. Since the panel 26 ends at a specific point at the lower corner 28 (i.e., O-ring 40), a low catenary arch (large radius) in line 42 is produced instead of a high catenary arch (small radius) common to prior systems. A low catenary arch (large radius) in line 42 eliminates wrinkles that usually occur above the catenary arch. Further, the stress (the internal resistance per unit area of a body subjected to external forces) on the panel 26 is evenly distributed over the surface of the body of the panel 26 with this procedure, thereby creating a uniformly tensioned taut panel 26 having aesthetically pleasing characteristics.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A building structure, comprising:

a plurality of arches, each arch spanning a transverse distance and being longitudinally spaced apart from adjacent arches, each arch having lower ends attached to base plates, the base plates having at least one J-bracket with a flat center and a curled end located near each respective arch, the base plates for securing the lower ends of the arches in the longitudinally spaced, transversely extending, vertical positions; and a panel coupled to the adjacent arches, the panel having a width corresponding to the longitudinal distance between adjacent arches, a length corresponding to the transverse distance spanned by the arches, reinforced lower corners located near the lower ends of the arches, means for connecting the panel to corresponding arches, and a first line secured to longitudinally opposite corners and extending generally arcuately therebetween and a second line secured by the J-bracket to longitudinally opposite corners and extending generally linearly therebetween, both first and second lines being spaced a predetermined distance apart in the transverse direction to thereby longitudinally and transversely tension the panel.

2. A building structure as set forth in claim 1, further comprising a plurality of horizontally extending purlins rigidly connected between the adjacent arches at opposite ends of the purlins.

3. A building structure as set forth in claim 2, further comprising a plurality of lines connected to the base plates and opposite ends of the purlins to form cross-braces between the adjacent arches.

4. A building structure as set forth in claim 1, wherein the first line forms a catenary arch with a substantially large radius.

5. A building structure as set forth in claim 1, wherein each of the arches has a pair of outwardly opening slots formed in a pair of opposite sides of the arch and the means for connecting the side edges of the panel to the arches includes ropes attached to the side edges of the panel and threaded through corresponding ones of the slots.

6. A portable building structure, comprising:

a plurality of arches, each arch spanning a transverse distance and being longitudinally spaced apart from adjacent arches, each arch having lower ends attached to base plates, the base plates having at least one J-bracket with a flat center and a curled end located near each respective arch, the base plates securing the lower ends of the arches in the longitudinally spaced, transversely extending, vertical positions;

a plurality of horizontally extending purlins rigidly connected between the adjacent arches at opposite ends of the purlins;

a plurality of lines connected to base plates and opposite ends of the purlins to form cross-braces between the adjacent arches; and one or more panels attached to the adjacent arches, each panel having a width corresponding to the longitudinal distance between adjacent arches, a length corresponding to the transverse distance spanned by the arches, means for connecting the panels to corresponding arches, and reinforced lower corners located near the lower ends of the arches, wherein each panel has a first line secured to longitudinally opposite reinforced corners and extending generally arcuately therebetween and a second line secured by the J-bracket to longitudinally opposite reinforced corners and extending generally linearly therebetween, both first and second lines being spaced a predetermined distance apart in the transverse direction to thereby longitudinally and transversely tension each respective panel.

7. A building structure as set forth in claim 6, wherein the reinforced corners comprise means for creating evenly distributed tensile forces throughout the panel when a point at the lower end of the panel is tensioned.

8. A building structure as set forth in claim 6, wherein each lower reinforced corner includes at least three layers of reinforcement.

9. A building structure as set forth in claim 8, wherein the first layer is the same material as each panel and is welded to the panel, the second layer comprises a plurality of PVC material prongs welded to the panel and first layer and extending from the lower corner of the panel at varying angles, wherein the ends of each prong form an arcuate face and wherein the PVC prongs and the arcuate face are welded into the panels, and the third layer is a pronged web of tightly woven cloth, wherein each cloth prong is aligned with the PVC prongs and is stitched into the PVC material and the panel.

10. A building structure as set forth in claim 9, wherein each lower end of each cloth prong located near the lower end of the panels joins at one point.

11. A building structure as set forth in claim 10, wherein the joint between each lower end of each cloth prong is a metallic O-ring.

12. A building structure as set forth in claim 10, wherein the first layer and the second layer is ultrasonically welded to the panel.

13. A building structure as set forth in claim 10, wherein the first layer and the second layer is dielectrically welded to the panel.

14. A building structure as set forth in claim 6, wherein the first line forms a catenary arch with a substantially large radius.

15. A building structure as set forth in claim 6, wherein the first line includes a turnbuckle for tensioning the first line between the opposite lower corners of the panel and the second line includes a winch for tensioning the second line between the opposite lower corners of the panel.

16. A building structure as set forth in claim 6, wherein each of the arches has a pair of outwardly opening slots formed in a pair of opposite sides of the arch and the means for connecting the side edges of the panels to the arches includes ropes attached to the side edges of the panels and threaded through corresponding ones of the slots.

* * * * *